US009780447B2

(12) United States Patent
Maca et al.

(10) Patent No.: US 9,780,447 B2
(45) Date of Patent: Oct. 3, 2017

(54) MULTI-ELEMENT ANTENNA CALIBRATION TECHNIQUE

(71) Applicant: CommScope Technologies LLC, Hickory, NC (US)

(72) Inventors: Gregory A. Maca, Lynchburg, VA (US); Jonathon C. Veihl, New Lenox, IL (US)

(73) Assignee: CommScope Technologies LLC, Hickory, NC (US)

( * ) Notice: Subject to any disclaimer, the term of this patent is extended or adjusted under 35 U.S.C. 154(b) by 426 days.

(21) Appl. No.: 14/372,550

(22) PCT Filed: Jan. 22, 2013

(86) PCT No.: PCT/US2013/022481

§ 371 (c)(1),
(2) Date: Jul. 16, 2014

(87) PCT Pub. No.: WO2013/112443

PCT Pub. Date: Aug. 1, 2013

(65) Prior Publication Data

US 2014/0354507 A1 Dec. 4, 2014

Related U.S. Application Data

(60) Provisional application No. 61/590,099, filed on Jan. 24, 2012.

(51) Int. Cl.
*H01Q 3/26* (2006.01)

(52) U.S. Cl.
CPC ..... *H01Q 3/26* (2013.01); *H01Q 3/267* (2013.01)

(58) Field of Classification Search
CPC ..... H01Q 3/26
See application file for complete search history.

(56) References Cited

U.S. PATENT DOCUMENTS 5,027,127 A 6/1991 Shnitkin et al.
8,681,046 B2 3/2014 Dumon et al.
(Continued)

FOREIGN PATENT DOCUMENTS

CN 101582714 A 11/2009
CN 102013929 A 4/2011
(Continued)

OTHER PUBLICATIONS

Chinese Office Action: Mailed Aug. 19, 2015 for the corresponding CN Application No. CN201380011601.6 along with an Abstract English.

(Continued)

*Primary Examiner* — Graham Smith
*Assistant Examiner* — Noel Maldonado
(74) *Attorney, Agent, or Firm* — Myers Bigel, P.A.

(57) ABSTRACT

Antenna system having an antenna array with multiple sub-arrays, each having one or more antenna elements, is calibrated using a distributed calibration antenna element, such as a leaky coaxial cable, that spans across at least two and possibly all of the sub-arrays. To calibrate the transmit (TX) paths of the sub-arrays, TX calibration test signals are transmitted by the sub-arrays, captured by the distributed calibration element, and processed by a corresponding calibration radio. To calibrate the receive (RX) paths of the sub-arrays, an RX calibration test signal is generated by the calibration radio, transmitted by the distributed calibration element, captured by the sub-arrays, and processed by their corresponding radios. Cross-correlation between the calibration and captured signals is performed to derive the complex gain of each sub-array transmitter and receiver, which provides information for aligning the gain, phase, and delay of the different TX and RX paths of the antenna array.

15 Claims, 4 Drawing Sheets

(56) References Cited

U.S. PATENT DOCUMENTS

| | | | | |
|---|---|---|---|---|
| 9,019,153 | B1 * | 4/2015 | Schuss | G01S 7/4026 342/165 |
| 2001/0005685 | A1 * | 6/2001 | Nishimori | H01Q 3/2605 455/562.1 |
| 2007/0149251 | A1 | 6/2007 | Jeon | |
| 2007/0205955 | A1 * | 9/2007 | Korisch | H01Q 1/246 343/853 |
| 2008/0012748 | A1 | 1/2008 | Ahn | |
| 2011/0076965 | A1 * | 3/2011 | Takahashi | H04B 5/0018 455/75 |

FOREIGN PATENT DOCUMENTS

| | | | |
|---|---|---|---|
| CN | 102315868 | A | 1/2012 |
| CN | 202103169 | U | 1/2012 |
| FR | 2941333 | A1 | 7/2010 |
| WO | WO2013112443 | A1 | 8/2013 |

OTHER PUBLICATIONS

English Translation received Dec. 2, 2015 of the Chinese Office Action: Mailed Aug. 19, 2015 for the corresponding CN Application No. CN201380011601.6.

International Preliminary Report On Patentability; Mailed Jul. 29, 2014 for the related PCT Application No. PCT/US2013/022481.

* cited by examiner

100

200

MULTI-ELEMENT ANTENNA CALIBRATION TECHNIQUE

CROSS-REFERENCE TO RELATED APPLICATIONS

This application claims the benefit of the filing date of U.S. provisional application No. 61/590,099, filed on Jan. 24, 2012, the teachings of which are incorporated herein by reference in their entirety.

BACKGROUND

Field of the Invention

The present invention relates to communication systems and, more specifically but not exclusively, to antenna arrays, such as those for cellular communication systems.

Description of the Related Art

This section introduces aspects that may help facilitate a better understanding of the invention. Accordingly, the statements of this section are to be read in this light and are not to be understood as admissions about what is prior art or what is not prior art.

An active antenna comprises an array of radiating elements or sub-arrays of radiating elements that are excited in a particular set of relative amplitude and phase excitations to create a desired radiation pattern. For an active array having a column of elements (or sub-arrays), parameters such as downtilt angle, beamwidth, and sidelobe levels can be adjusted by modifying the amplitude and phase excitations at the sub-array level. The relative excitations are controlled by amplifiers, electronic phase shifters, and digital radios at each sub-array or element.

A calibration process is performed to define the response of one transceiver chain relative to the others in order to establish a baseline reference between the elements. Since this reference may change over time due to temperature, drift, or other phenomenon, the calibration process should be easy to use and able to be repeated as needed during the lifetime of the product. The passive components of the calibration process should be time invariant. Low cost and simplicity of implementation are other desired features. Calibration should be applied independently to the transmit path on the downlink and to the receive path on the uplink.

A typical calibration circuit might consist of a directional coupler at each element or sub-array level, connected via interconnects to an n-way splitter/combiner network that combines the coupled signals to a common calibration port. This method has the disadvantage of requiring additional couplers, power dividers, cables, and interconnects with preferably time-invariant responses to transport the signal to the calibration transceiver, all of which add complexity and cost.

BRIEF DESCRIPTION OF THE DRAWINGS

Other embodiments of the invention will become more fully apparent from the following detailed description, the appended claims, and the accompanying drawings in which like reference numerals identify similar or identical elements.

DETAILED DESCRIPTION

Figure 1:
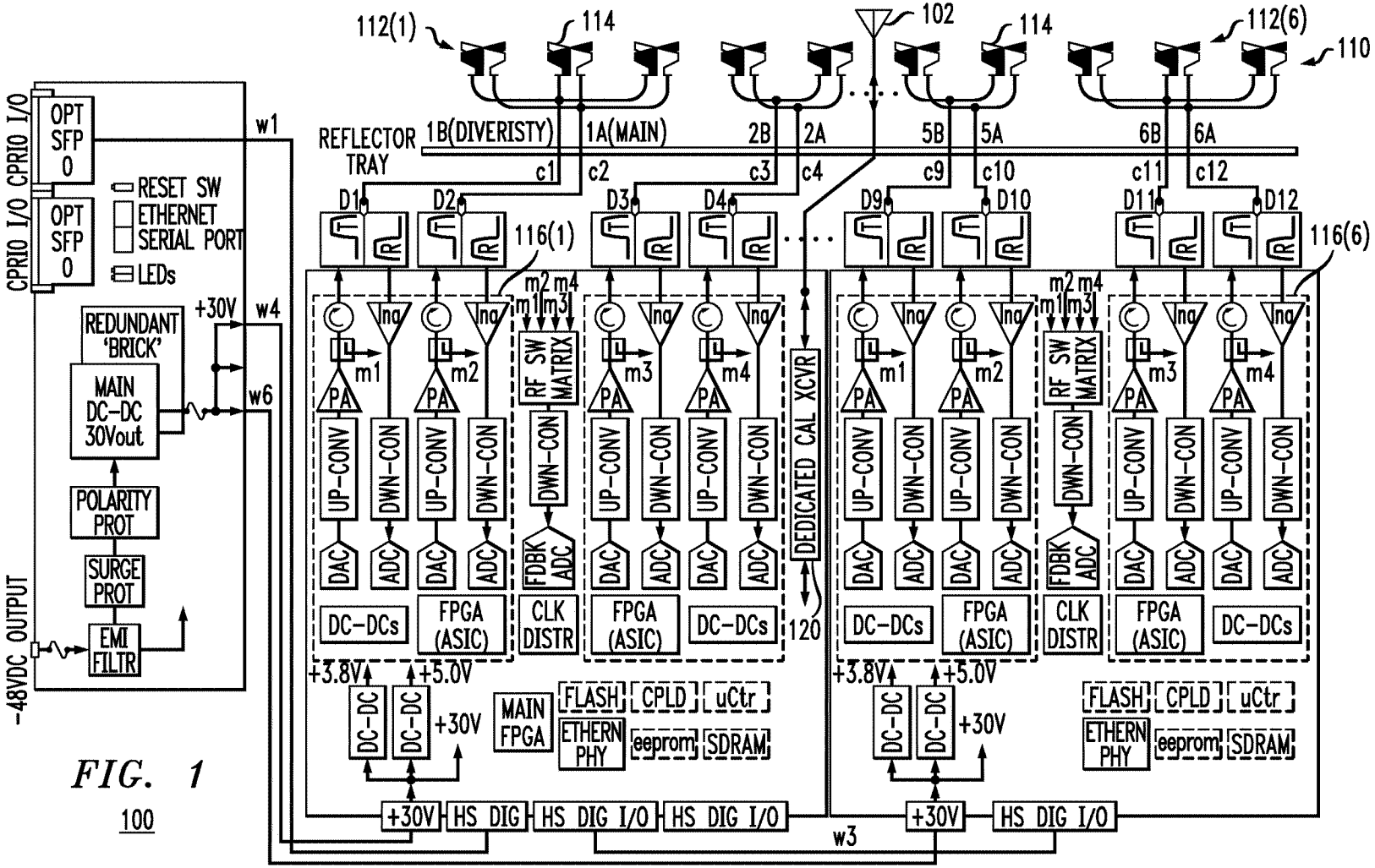
FIG. 1 is a schematic block diagram of an antenna system that employs an improved calibration technique, in which an additional calibration antenna element is provided to the aperture.

FIG. 1 is a schematic block diagram of an antenna system 100 that employs an improved calibration technique, in which an additional calibration antenna element 102 is provided to the aperture, where the technique relies on the time-invariant nature of the mutual coupling established between the radiation patterns of the other antenna elements and the calibration element.

In this particular exemplary embodiment, antenna system 100 has a dual-polarized antenna array 110 consisting of six sub-arrays 112(1)-112(6), each of which has either two or three antenna elements 114. Note that sub-arrays 112(3)-112(4) and the corresponding electronics associated with those sub-arrays are not explicitly shown in FIG. 1, but are part of exemplary antenna system 100. As shown in FIG. 1, each sub-array 112(*i*) has a dual-transceiver radio 116(*i*) that is capable of concurrently (i) providing one or two different downlink signals for radiation from one or more of the corresponding antenna elements 114 of sub-array 112(*i*) and/or (ii) processing one or two different uplink signals received at one or more of those corresponding antenna elements 114. Note that, for a given sub-array 112(*i*), the one or more antenna elements 114 involved in downlink transmission may be but, do not have to be, the same one or more antenna elements 114 involved in uplink reception.

In addition, calibration element 102 has its own dedicated single-transceiver radio 120 that is capable of independently providing an outgoing calibration signal for radiation from calibration element 102 and processing an incoming calibration signal received at calibration element 102.

According to one possible calibration technique, to calibrate the transmit (TX) paths of antenna array 110, unique and linearly independent TX calibration test signals are concurrently radiated from all of the different sub-arrays 112, and calibration radio 120 processes the signal captured by calibration element 102, which signal corresponds to a weighted sum of the calibration test signals transmitted by the different sub-arrays 112 and wirelessly coupled to calibration element 102. Using digital signal processing, the known TX calibration test signals can then be cross-correlated with the combined received signal to derive the complex gain for each TX path. This information should provide the correction factors needed to align the gain, phase, and delay of each TX path in antenna array 110.

To calibrate the receive (RX) paths of antenna array 110, a unique RX calibration test signal is generated by calibration radio 120 and transmitted from calibration element 102, and the resulting received signals captured by the different sub-arrays 112 are processed by the corresponding radios 116. Using digital signal processing, the known RX calibration test signal can then be cross-correlated with the different received signals to derive the complex gain for each RX path. This information should provide the correction factors needed to align the gain, phase, and delay of each RX path in antenna array 110.

Note that, if the TX and RX calibration test signals are properly designed, this calibration technique can be implemented while normal uplink and downlink wireless traffic is concurrently being processed by antenna system 100.

A challenge with the calibration technique of FIG. 1 is finding a suitable location for calibration element 102 that provides coupling levels within a desired range of values and high enough above the noise floor to provide an acceptable calibration routine. In one implementation of an antenna system having a central, monopole calibration element similar to calibration element 102 of antenna system 100, where the antenna array had seven sub-arrays instead of six, the coupling values varied between about −15 dB and about −60 dB, for a dynamic range of approximately 45 dB.

Figure 2:
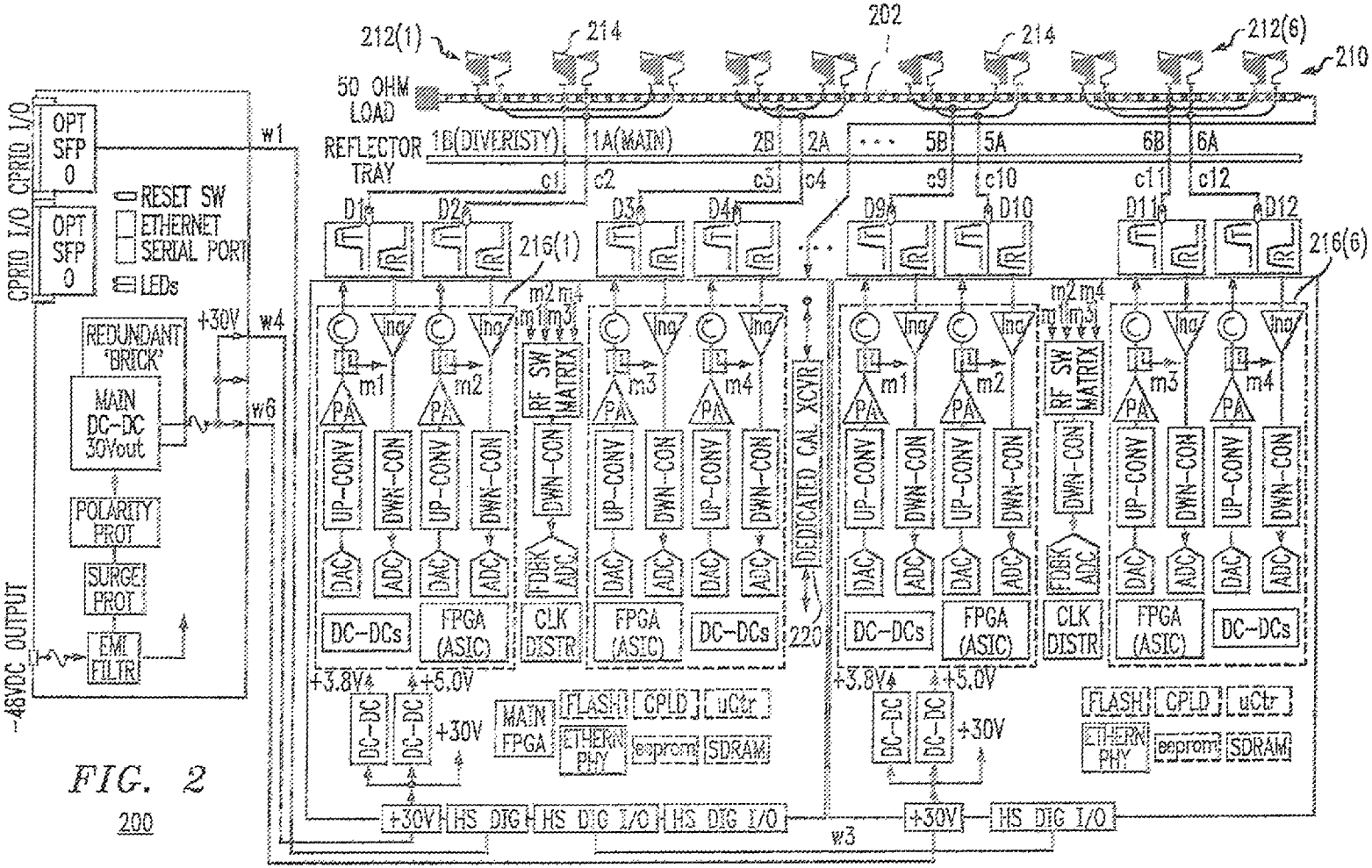
FIG. 2 is a schematic block diagram of an antenna system that employs a further improved calibration technique, in which a distributed calibration antenna element is provided to the aperture.

FIG. 2 is a schematic block diagram of an antenna system 200 that employs a further improved calibration technique, in which a distributed calibration antenna element 202 is provided to the aperture, where the technique relies on the time-invariant nature of the mutual coupling established between the radiation patterns of the other antenna elements and the distributed calibration element. In one implementation, distributed antenna element 202 extends from one end of the radiating aperture to the other in order to reduce the dynamic range of the coupling values experienced by the various sub-arrays 212.

In this particular exemplary embodiment and similar to antenna system 100 of FIG. 1, antenna system 200 has a dual-polarized antenna array 210 consisting of six sub-arrays 212(1)-212(6), each of which has either two or three antenna elements 214. As in FIG. 1, sub-arrays 212(3)-212(4) and the corresponding electronics associated with those sub-arrays are not explicitly shown in FIG. 2, but are part of exemplary antenna system 200. As shown in FIG. 2, each sub-array 212(*i*) has a dual-transceiver radio 216(*i*) that is capable of concurrently (i) providing one or two different downlink signals for radiation from one or more of the corresponding antenna elements 214 of sub-array 212(*i*) and/or (ii) processing one or two different uplink signals received at one or more of those corresponding antenna elements 214. Note that, for a given sub-array 212(*i*), the one or more antenna elements 214 involved in downlink transmission may be but, do not have to be, the same one or more antenna elements 214 involved in uplink reception.

As in antenna system 100 of FIG. 1, distributed calibration element 202 has its own dedicated single-transceiver calibration radio 220 that is capable of independently providing an outgoing calibration signal for radiation from distributed calibration element 202 and processing an incoming calibration signal received at distributed calibration element 202.

In one possible implementation, distributed calibration element 202 is a coaxial cable running along the length of antenna array 210 and having slots, holes, or other types of openings in the outer (grounded) conductor layer along the length of the coaxial cable, such that the coaxial cable forms a leaky antenna element that radiates wireless signals along its length when an appropriate signal is applied to the inner conductor of the coaxial cable. In addition, the openings in the coaxial cable enable the coaxial cable to function as a distributed antenna element capable of capturing incoming wireless signals along its length to produce a received signal on the inner conductor.

As mentioned previously, the motivation for using a distributed calibration element, like element 202 of FIG. 2, instead of a single, monopole calibration element, like element 102 of FIG. 1, is to provide more uniform coupling between the calibration element and the different antenna elements of the antenna array. In one implementation, an antenna system employed a Radiax slotted coaxial cable from CommScope, Inc., of Hickory, N.C., as the distributed calibration element, where the antenna array had seven sub-arrays instead of six. The resulting coupling values varied between about −30 dB and about −55 dB, for a dynamic range of approximately 25 dB, which is significantly more uniform than the approximately 45 dB dynamic range that resulted from employing a conventional monopole calibration element near the center of the same antenna array.

A leaky coaxial cable is just one way of implementing distributed calibration element 202. Another way is to distribute multiple radiating elements throughout antenna array 210 in a pattern to reduce the range of the coupling levels. The multiple elements could be combined in either a corporate or series feed for connection to the transceiver port of calibration radio 220. Another way is to integrate the radiation sources and interconnecting transmission lines into a single transmission line, such as an air microstrip, mounted on the reflector surface. Other ways of implementing distributed calibration element 202 are also possible, such as (without limitation) slotted waveguide, rectangular or circular for example, or planar stripline with radiating slots on one or both ground planes.

Figure 3:
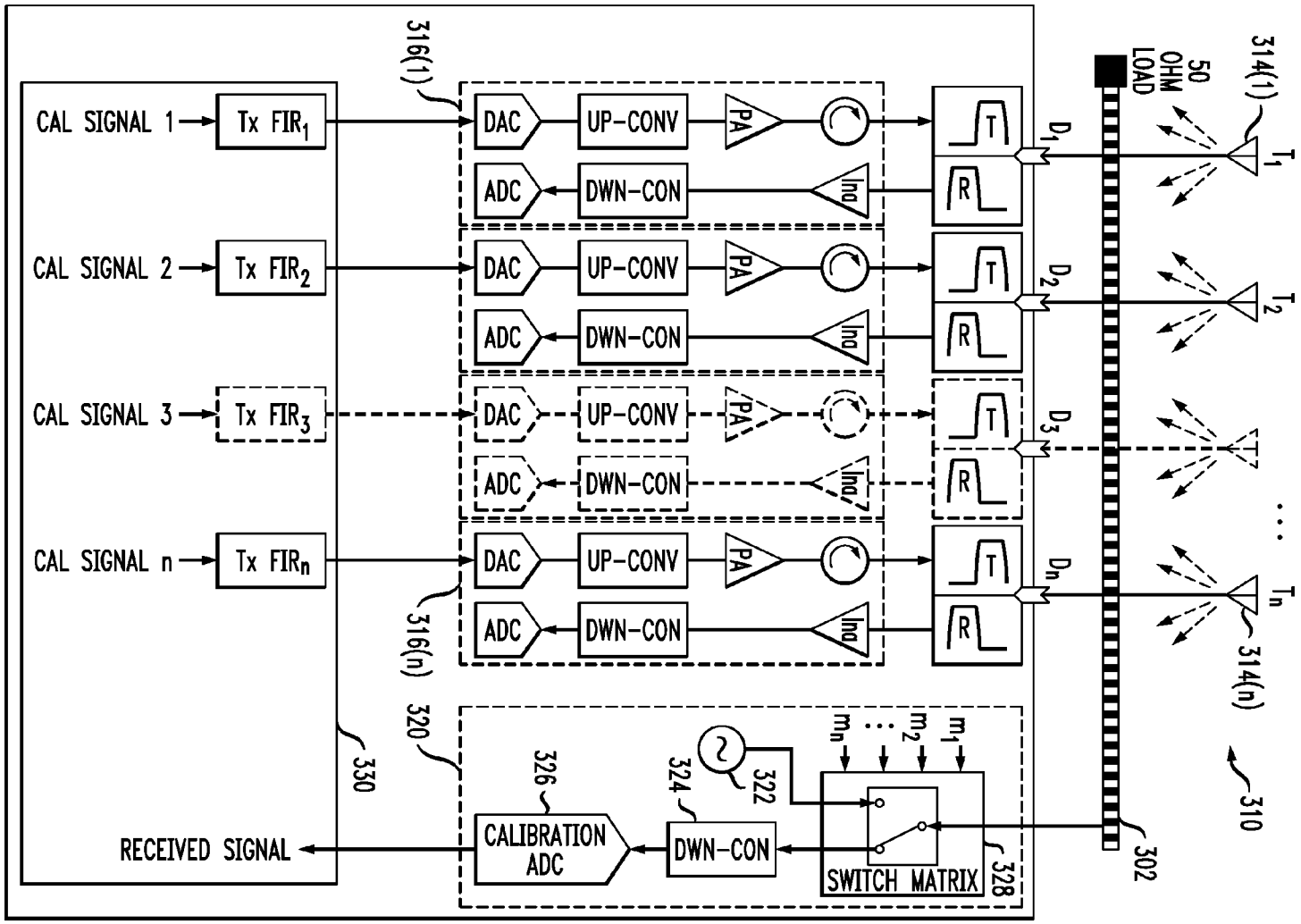
FIGS. 3 and 4 are schematic block diagrams of a different antenna system that employs the same calibration technique as the antenna system of FIG. 2.
Figure 4:
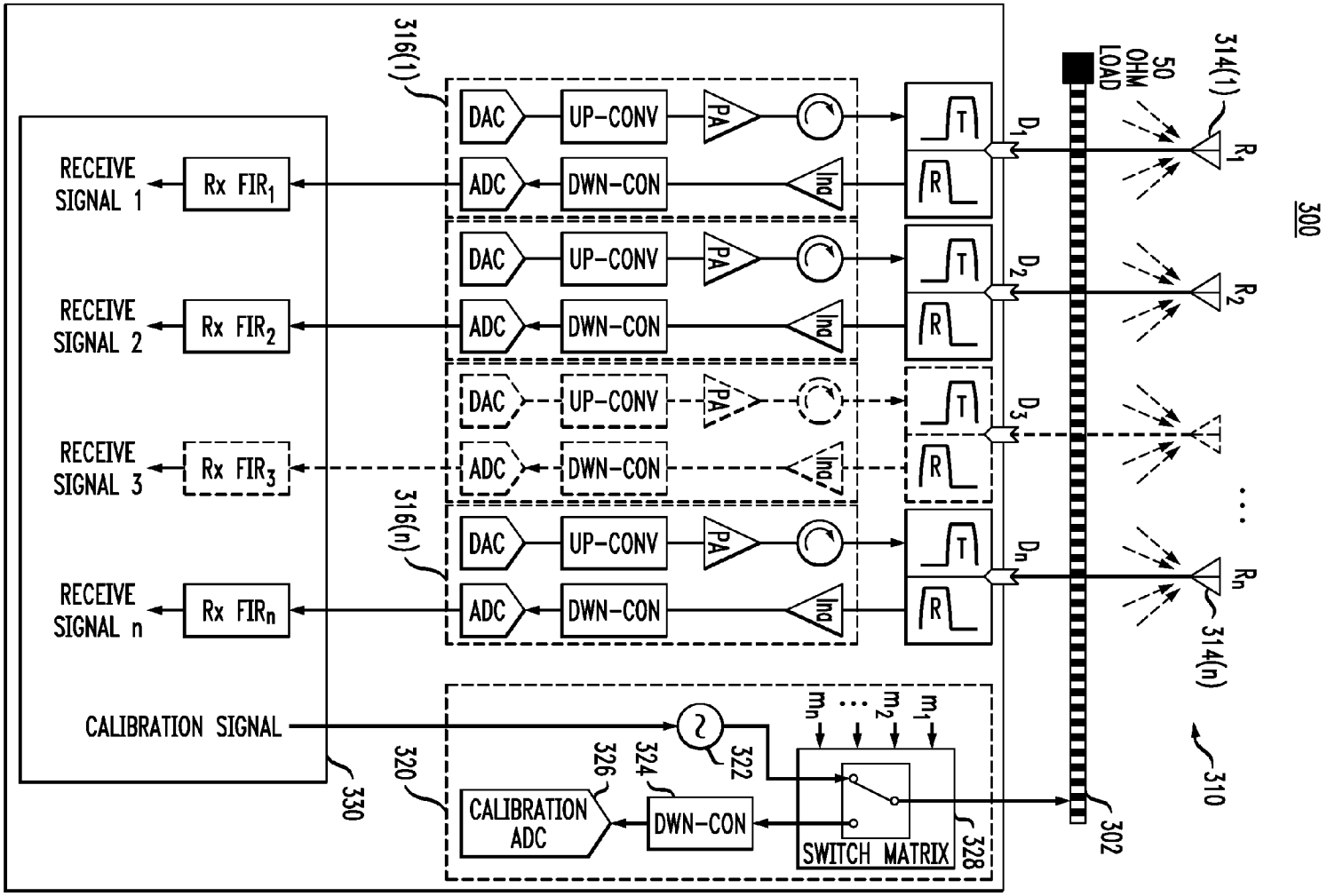

FIGS. 3 and 4 are schematic block diagrams of an antenna system 300 that employs the same distributed calibration technique as antenna system 200 of FIG. 2, but, in this case, for an antenna array 310 having a set of n antenna elements 314(1)-314(*n*), where each antenna element 314(*i*) has a single-transceiver radio 316(*i*). Note that, in antenna system 300, each antenna element 314(*i*) may be said to correspond to a different sub-array of antenna array 310, where each sub-array has only one antenna element. As in antenna system 200, antenna system 300 has a distributed calibration antenna element 302, such as a leaky coaxial cable, running along the length of antenna array 310, and a dedicated calibration radio 320, which is analogous to calibration radio 220 of FIG. 2.

As shown in FIGS. 3 and 4, calibration radio 320 has (i) a calibration transmit (TX) path having calibration test signal generator 322, (ii) a calibration receive (RX) path having a down converter 324 and an analog-to-digital converter (ADC) 326, and (iii) a switch matrix 328 that selectively connects distributed calibration element 302 to either the TX path or the RX path of calibration radio 320. Antenna system 300 also has digital signal processor (DSP) 330 configured to provide digital signal processing to support the calibration of antenna system 300. FIG. 3 shows antenna system 300 configured to calibrate the TX paths of antenna elements 314, while FIG. 4 shows antenna system 300 configured to calibrate the RX paths of antenna elements 314.

Referring to FIG. 3, in order to calibrate the TX paths of antenna elements 314, switch matrix 328 is configured to connect distributed calibration element 302 to the RX path of calibration radio 320. Unique and linearly independent TX calibration test signals are then concurrently radiated from all of the different antenna elements 314, distributed calibration element 302 captures coupled wireless signals along its length, and calibration radio 320 processes the resulting received signal captured by distributed calibration element 302, which signal corresponds to a weighted sum of the calibration test signals transmitted by the different antenna elements 314 and wirelessly coupled to distributed calibration element 302. Using the digital signal processing of DSP 330, the known TX calibration test signals can then be cross-correlated with the combined received signal to derive the complex gain for each TX path in antenna array 310. This information should provide the correction factors needed to align the gain, phase, and delay of each TX path in antenna array 310.

Referring to FIG. 4, in order to calibrate the receive (RX) paths of antenna elements 314, switch matrix 328 is configured to connect distributed calibration element 302 to the TX path of calibration radio 320. A unique RX calibration test signal is generated by calibration radio 320 and wirelessly transmitted along the length of distributed calibration element 302, and the resulting received signals wirelessly captured by the different antenna elements 314 are processed by the corresponding radios 316. Using the digital signal processing of DSP 330, the known RX calibration test signal can then be cross-correlated with the different received signals to derive the complex gain for each RX path in antenna array 310. This information should provide the correction factors needed to align the gain, phase, and delay of each RX path in antenna array 310.

Note that, if the TX and RX calibration test signals are properly designed, this calibration technique can be implemented while normal uplink and downlink wireless traffic is concurrently being processed by antenna system 300.

Although the calibration technique has been described in the context of scenarios in which (i) the TX paths of all of the sub-arrays in the antenna array are calibrated concurrently and (ii) the RX paths of all of the sub-arrays in the antenna array are calibrated concurrently, in general, the calibration technique can be implemented in the context of scenarios in which (i) one or more TX paths are calibrated at a time and/or (ii) one or more RX paths are calibrated at a time. Furthermore, as long as the calibration test signals are properly designed, the calibration technique can be implemented with or without the presence of normal wireless traffic.

Although the calibration technique has been described in the context of antenna systems in which the distributed calibration antenna element spans across the entire length of the antenna array, in general, the calibration technique can be implemented in the context of antenna systems having distributed calibration antenna elements that span across at least two of the sub-arrays of the antenna array. As long as the distributed calibration element spans across at least two of the sub-arrays, the resulting dynamic range of the coupling between the distributed calibration element and all of the sub-arrays in the antenna array should be smaller than the dynamic range of the coupling between a single monopole calibration element and the sub-arrays of that same antenna array.

Although the calibration technique has been described in the context of particular antenna systems having particular numbers of sub-arrays and antenna elements, in general, the calibration technique can be implemented in the context of antenna systems having multiple sub-arrays, each sub-array having one or more antenna elements.

Although the calibration technique has been described in the context of antenna systems having linear antenna arrays with co-linear antenna elements and one-dimensional distributed calibration antenna elements spanning the lengths of the linear antenna arrays, the disclosure is not so limited. In alternative embodiments, antenna systems may have two- or even three-dimensional antenna arrays with antenna elements distributed in two- or three-dimensional arrangements. Depending on the coupling requirements, such multi-dimensional antenna arrays may have one-, two-, or even three-dimensional distributed calibration antenna elements that, in some appropriate manner, span one, two, or even three dimensions of the antenna arrays.

For purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

It should be appreciated by those of ordinary skill in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain embodiments of this invention may be made by those skilled in the art without departing from embodiments of the invention encompassed by the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. An antenna system comprising:

an antenna array comprising a plurality of sub-arrays, each sub-array having one or more antenna elements;

a radio for each sub-array, each radio comprising one or more transceivers;

a distributed calibration antenna element distributed across at least two sub-arrays of the antenna array; and a calibration radio for the distributed calibration antenna element, the calibration radio comprising:

a transmit path configured to generate a receive calibration signal for transmission from the distributed calibration antenna element to the antenna array to calibrate receive paths of the antenna system;

a receive path configured to process a transmit calibration signal captured by the distributed calibration antenna element from the antenna array to calibrate transmit paths of the antenna system.

2. The invention of claim 1, wherein the distributed calibration antenna element is distributed across all of the sub-arrays of the antenna array.

3. The invention of claim 1, wherein the calibration radio further comprises a switch matrix configured to selectively connect the distributed calibration antenna element to either the transmit path or the receive path of the calibration radio.

4. The invention of claim 1, wherein the distributed calibration antenna element is a leaky coaxial cable.

5. A method of calibrating transmit (TX) paths of an antenna system comprising (i) an antenna array with a plurality of sub-arrays, each sub-array having one or more antenna elements, and (ii) a radio for each sub-array, each radio comprising one or more transceivers, the method comprising:

(a) transmitting one or more TX calibration test signals from one or more of the sub-arrays;

(b) capturing a TX received signal corresponding to the one or more TX calibration test signals using a distributed calibration antenna element that is distributed across at least two sub-arrays of the antenna array;

(c) processing the TX received signal using a calibration radio for the distributed calibration antenna element to generate TX digital signals; and (d) processing the TX digital signals to calibrate the TX paths of the antenna system.

6. The method of claim 5, further comprising:

(e) transmitting an RX calibration test signal from the distributed calibration antenna element;

(f) capturing one or more RX received signals corresponding to the RX calibration test signal using one or more of the sub-arrays of the antenna array;

(g) processing the one or more RX received signals using the corresponding radios for the one or more sub-arrays to generate RX digital signals; and (h) processing the RX digital signals to calibrate RX paths of the antenna system.

7. The method of claim 5, wherein the distributed calibration antenna element is distributed across all of the sub-arrays of the antenna array.

8. The method of claim 5, wherein the distributed calibration antenna element is a leaky coaxial cable.

9. A method of calibrating receive (RX) paths of an antenna system comprising (i) an antenna array with a plurality of sub-arrays, each sub-array having one or more antenna elements, and (ii) a radio for each sub-array, each radio comprising one or more transceivers, the method comprising:

(a) transmitting an RX calibration test signal from a distributed calibration antenna element that is distributed across at least two sub-arrays of the antenna array;

(b) capturing one or more RX received signals corresponding to the RX calibration test signal using one or more of the sub-arrays of the antenna array;

(c) processing the one or more RX received signals using the corresponding radios for the one or more sub-arrays to generate RX digital signals; and (d) processing the RX digital signals to calibrate the RX paths of the antenna system.

10. The method of claim 9, wherein the distributed calibration antenna element is distributed across all of the sub-arrays of the antenna array.

11. The method of claim 9, wherein the distributed calibration antenna element is a leaky coaxial cable.

12. The method of claim 5, wherein transmitting one or more TX calibration test signals from one or more of the sub-arrays comprises concurrently transmitting unique and linearly independent TX calibration test signals from the one or more of the sub-arrays.

13. The method of claim 5, wherein processing the TX digital signals to calibrate the TX paths of the antenna system comprises cross-correlating the TX calibration test signals with the TX digital signals to calibrate the TX paths of the antenna system.

14. The method of claim 5, wherein at least one TX calibration test signal is transmitted while non-calibration signals are processed by the antenna system.

15. The method of claim 12, wherein the distributed calibration antenna element is distributed across all of the sub-arrays of the antenna array, wherein the distributed calibration antenna element is a leaky coaxial cable, wherein processing the TX digital signals to calibrate the TX paths of the antenna system comprises cross-correlating the TX calibration test signals with the TX digital signals to calibrate the TX paths of the antenna system, and wherein at least one TX calibration test signal is transmitted while non-calibration signals are processed by the antenna system.

* * * * *